US008011194B2

(12) United States Patent
Dimmitt

(10) Patent No.: US 8,011,194 B2
(45) Date of Patent: Sep. 6, 2011

(54) COLLAPSIBLE COOLER CONVERTIBLE TO A STADIUM SEAT

(76) Inventor: James C. Dimmitt, Westlake, LA (US)

( * ) Notice: Subject to any disclaimer, the term of this patent is extended or adjusted under 35 U.S.C. 154(b) by 0 days.

(21) Appl. No.: 12/586,558

(22) Filed: Sep. 24, 2009

(65) Prior Publication Data

US 2011/0067428 A1 Mar. 24, 2011

(51) Int. Cl.
*F25B 1/00* (2006.01)

(52) U.S. Cl. ..... 62/115; 62/457.7

(58) Field of Classification Search ..... 62/457.7, 62/457.1, 115; 297/188.01, 188.08, 188.09, 297/188.1, 188.12, 188.13, 183.3, 183.5; 220/592.01, 592.2, 592.03, 592.04
See application file for complete search history.

(56) References Cited

U.S. PATENT DOCUMENTS 4,679,242 A * 7/1987 Brockhaus ..... 383/4
4,715,652 A * 12/1987 Ward ..... 297/252
5,785,427 A * 7/1998 Godshaw ..... 383/4
2005/0279123 A1* 12/2005 Maldonado et al. ..... 62/457.7
* cited by examiner

*Primary Examiner* — Mohammad Ali
(74) *Attorney, Agent, or Firm* — Keaty Law Firm

(57) ABSTRACT

A collapsible foldable cooler can be converted to a stadium seat by folding back a top lid and folding diagonally down the top portions of the sidewalls. The folded down top lid extends along the back wall, forming a part of a converted stadium seat backrest, while the sidewalls form the sides of the stadium seat.

27 Claims, 7 Drawing Sheets

COLLAPSIBLE COOLER CONVERTIBLE TO A STADIUM SEAT

BACKGROUND OF THE INVENTION

The present invention relates to coolers, and more particularly to a portable cooler and seat combination that can be detachably positioned on a stadium bench and collapsed to form a stadium seat.

Conventional coolers are known in the art and generally consist of an insulated container for keeping food and beverages cool at an outdoor location. Typically, a cooler is formed of a rigid material that retains its shape to form a cooler chamber for the food and beverage items. Conventional coolers have a removable lid that provides access to the contents of the cooler and also serves as a makeshift seat when the cooler is closed. Such coolers are bulky and cumbersome, and the lid forms an uncomfortable seating. Besides, many stadiums and outdoor concert venues do not allow the spectators to bring in beverages in coolers for safety reasons.

However, many sport fans or concert goers enjoy having an outdoor picnic before the event. Tailgate parties have become popular in the United States as social gatherings events that take place in stadium and arena parking lots before a sports game or a concert. In many cases, the tailgate party participants bring their food and beverages in all sorts of coolers, ice chests, etc., which they have to load back into their vehicles before entering the arena. Sometimes, the parked vehicle is located quite a distance from the tailgate party location, making it a chore to return the cooler or ice chest to the distant car.

There exists therefore a need to for a portable cooler that can be used in a stadium without breaking any of the venue regulations. Additionally, a need exists for a collapsible cooler that can be converted to a stadium seat in an easy, expeditious manner.

SUMMARY OF THE INVENTION

It is, therefore, an object of the present invention to provide a collapsible cooler that can be brought to a sporting event or a concert venue.

It is another object of the invention to provide a collapsible cooler that can be converted to a seat and detachably mounted on a stadium bench.

These and other objects of the invention are achieved through a provision of a collapsible cooler convertible to a stadium seat. The cooler has a flexible shell formed by a front wall, a back wall, a pair of opposing sidewalls and a top lid pivotally secured to the back wall. The top lid is configured to fold down against an inner surface of the back wall, while the sidewalls have top portions being configured to fold down against bottom portions of the sidewalls along a diagonal line. When folded downwardly and inwardly, the sidewalls form the stadium seat sides, while the bottom wall forms the stadium seat base.

BRIEF DESCRIPTION OF THE DRAWINGS

Reference will now be made to the drawings, wherein like parts are designated by like numerals, and wherein.

DETAIL DESCRIPTION OF THE INVENTION

Figure 3:
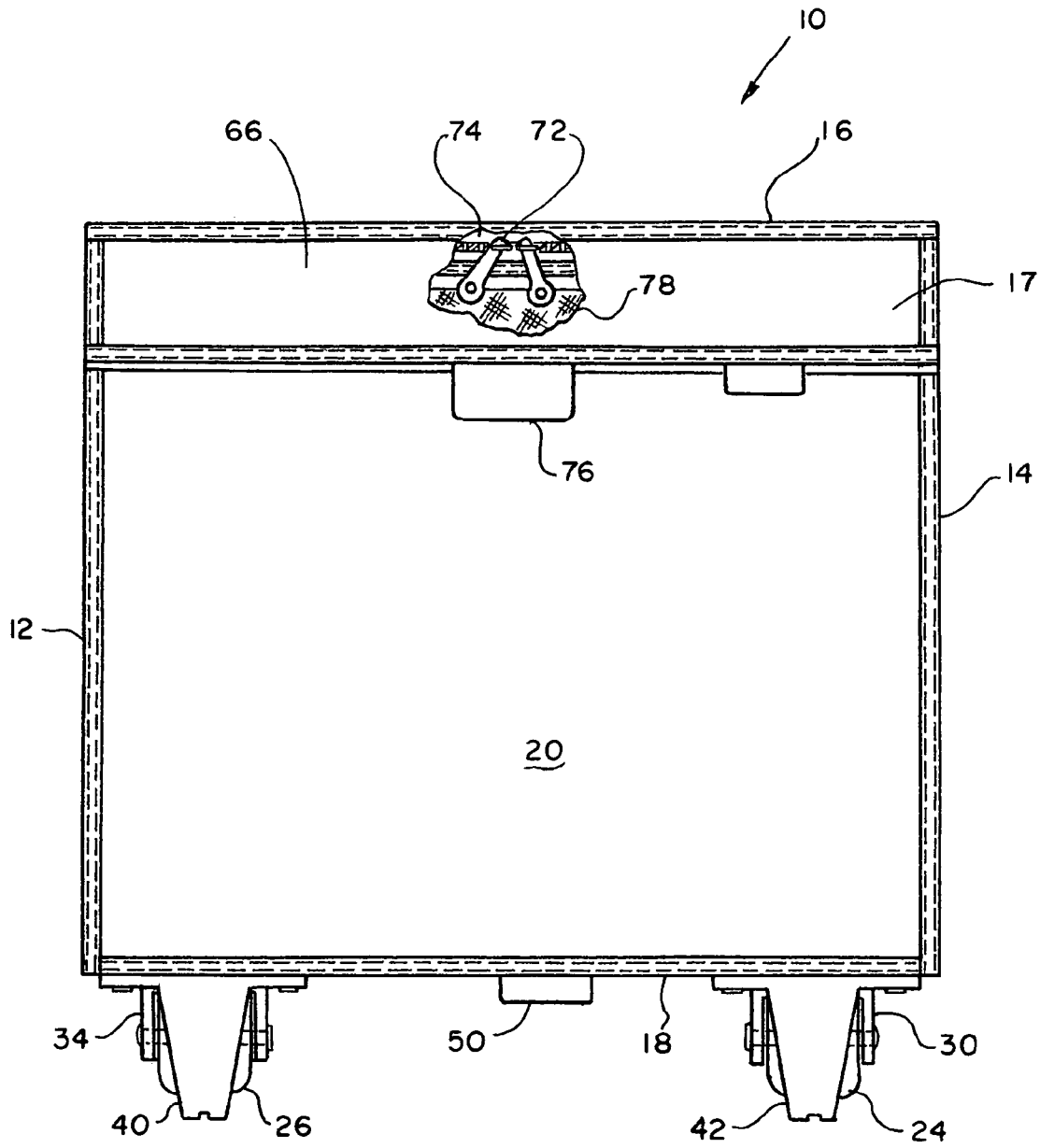
FIG. 3 is a front, partially cut-away view of the cooler apparatus of the present invention.
Figure 4:
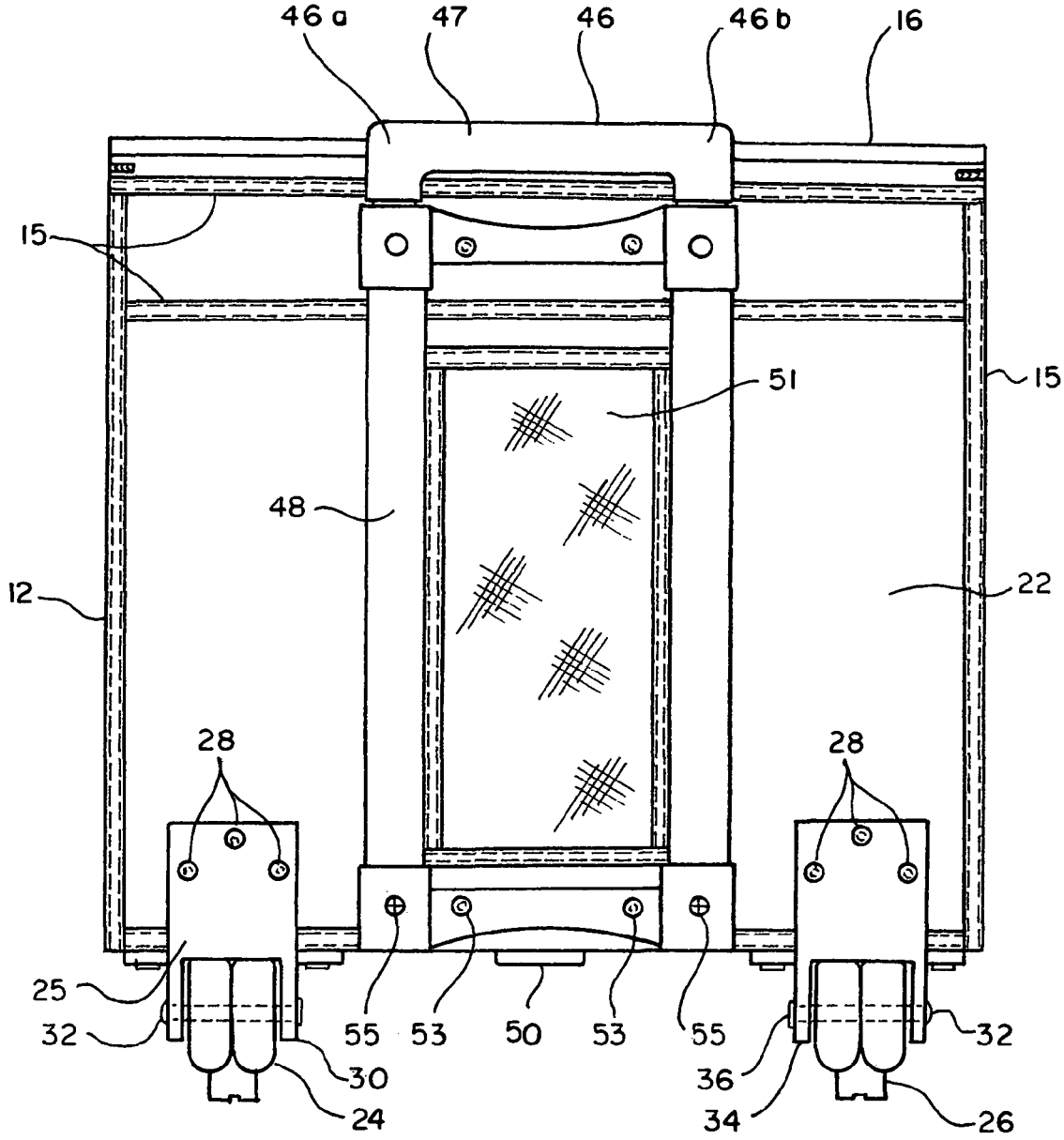
FIG. 4 is a rear, partially cut-away view of the cooler apparatus of the present invention.

Turning now to the drawings in more detail, numeral 10 designates the cooler apparatus of the instant invention. The cooler 10 has a six-sided collapsible body that defines an inner chamber 11 suitable for storing food and/or beverages. The body or shell of the cooler 10 comprises a first sidewall 12, a second sidewall 14, a top lid 16, a bottom wall 18, a front wall 20, and a rear wall 22. The shell can be formed from heavy duty 1000 D nylon or other suitable rip-resistant material. Heavy duty stitching (shown in phantom lines 15) can be used to secure the sidewalls, front and back, bottom and top panels together. A portion 17 of the top lid 16 overlaps an upper part of the front wall 20, as shown in FIG. 3.

The top lid 16 is pivotally engaged with the back wall 22 and pivotally folds along a pivot line 19 downwardly and inwardly. When the cooler 10 is converted to a stadium seat the top lid 16 extends substantially vertically along the back wall 22 and forms a part of the stadium seat back.

Figure 7:
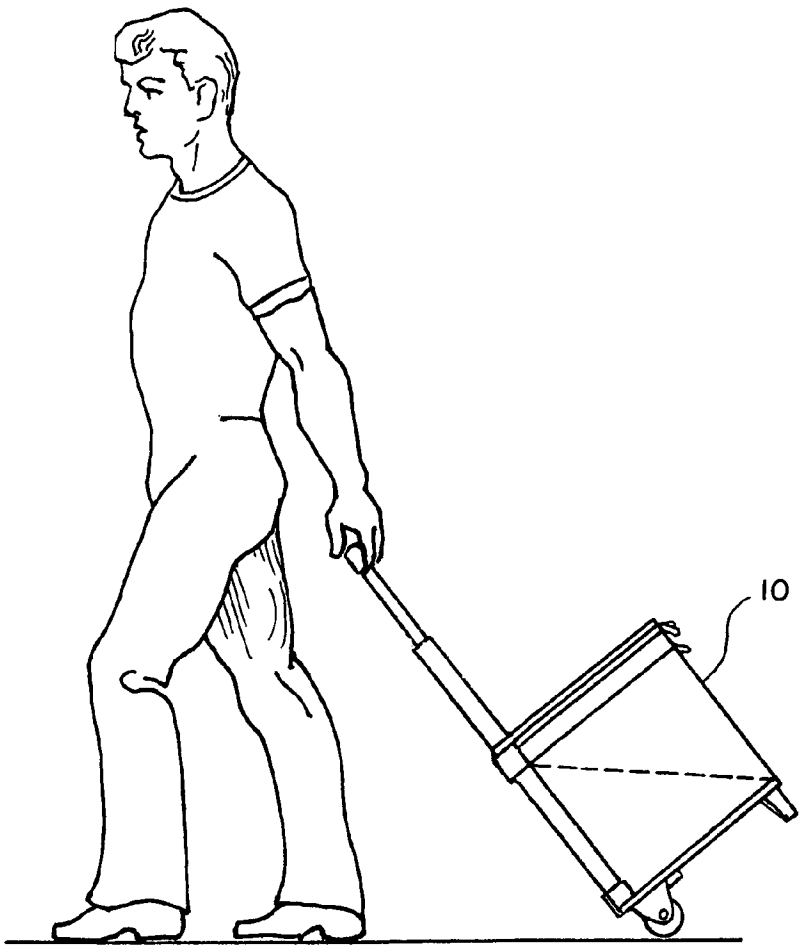
FIG. 7 is a schematic view illustrating the cooler apparatus of the present invention being rolled by a user.

A pair of rotating wheel sets 24 and 26 is attached to the rear wall 22 by respective wheel plates 25 and 27. The wheel plates 25 and 27 are fixedly secured to the rear wall 22 by a plurality of securing devices, such as for instance rivets 28. The wheel plate 25 supports a wheel bracket 30 having opposing sides, between which a wheel axle 32 is mounted. A similar bracket 34 carries an axle 36, about which the wheel set 26 rotates. The wheel sets 24 and 26 rotate about the axles 32 and 36, respectively, when the cooler 10 is pulled or pushed by a user, as shown in FIG. 7.

A pair of stationary legs 40, 42 is secured at the bottom front corners of the bottom wall 18. When stationary, the cooler 10 rests on the wheel sets 24, 26 and the front legs 40, 42.

Figure 2:
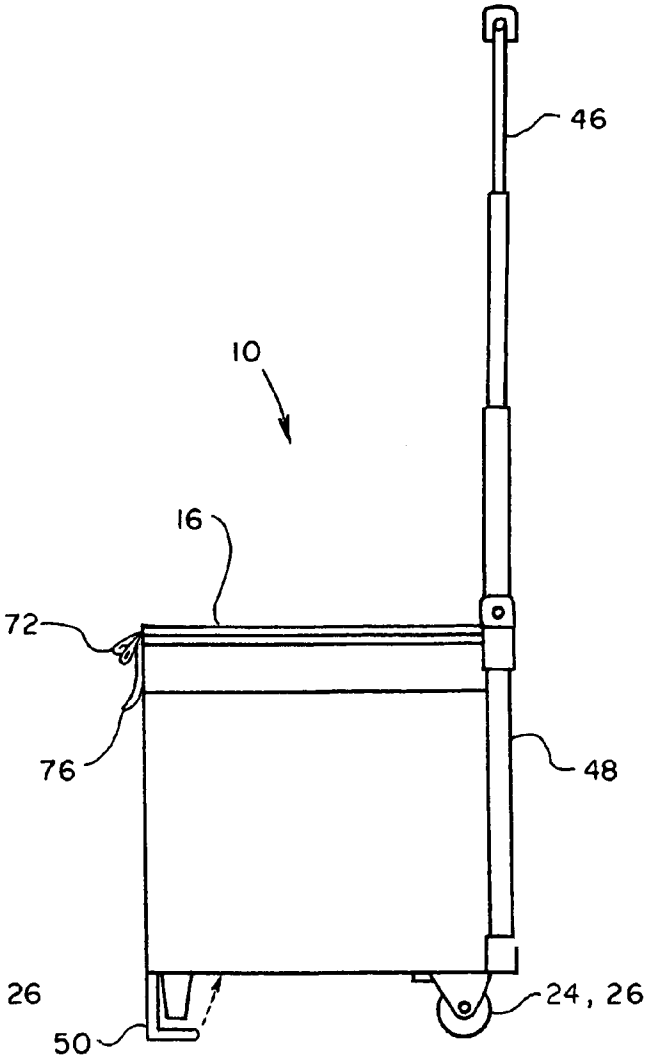
FIG. 2 is a side view of the cooler apparatus of the present invention, with a handle in an extended position.
Figure 10:
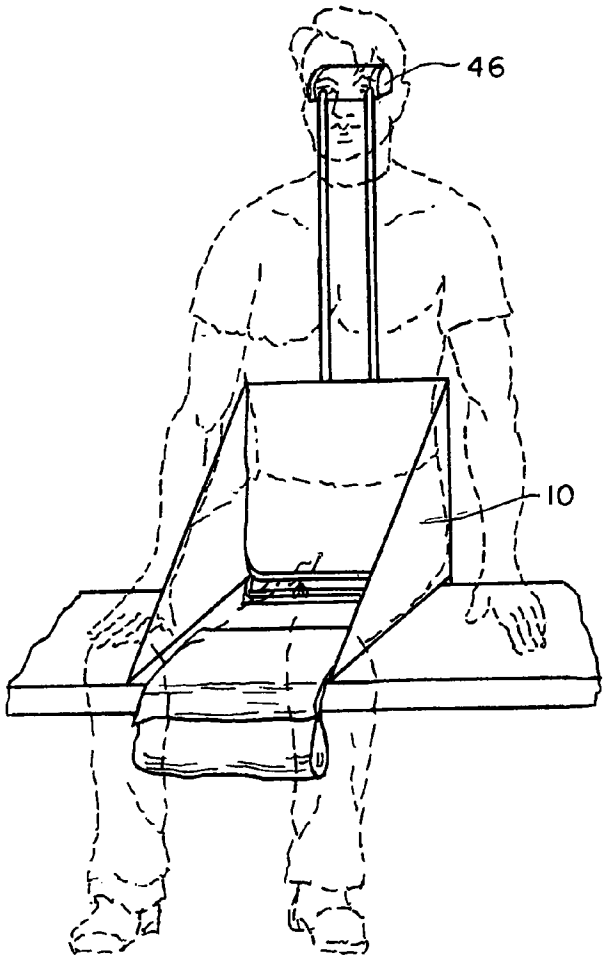
FIG. 10 is a schematic view illustrating the cooler apparatus of the present invention converted into a stadium seat, with the handle in an expanded position.
Figure 9:
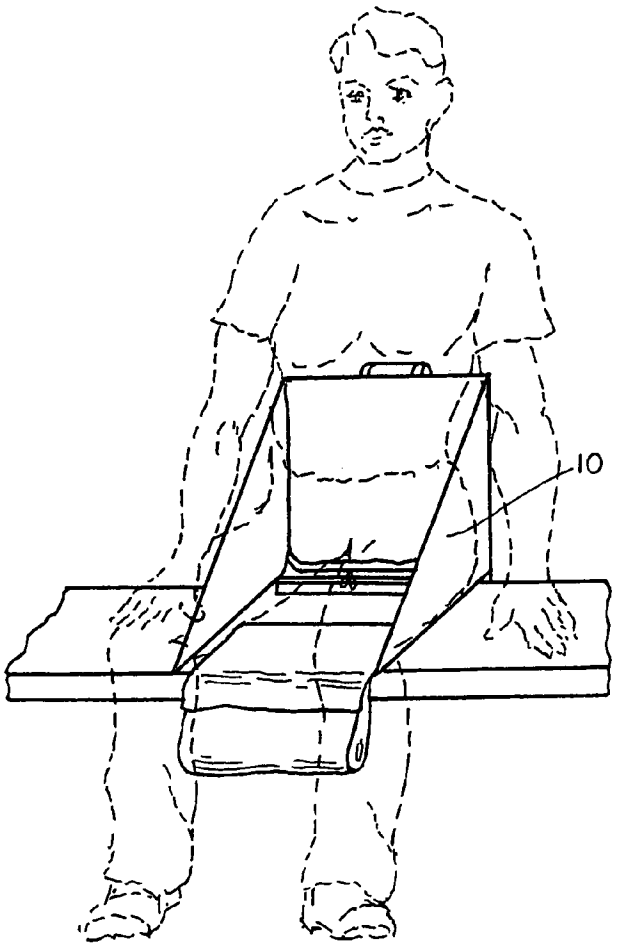
FIG. 9 is a schematic view illustrating the cooler apparatus of the present invention converted into a stadium seat, with the handle in a retracted position.

A retractable telescopically extendable handle 46 is fitted into a cage 48 attached to the rear wall 22. The handle 46 has two or more segments that telescopically engage in the cage 48 and extend into a position shown in FIG. 2. The handle 46 has a pair of spaced rods **46*a* and 46*b* that are retained in a spaced-apart parallel relationship by a grip rod 47. When the cooler 10 is used as a stadium seat, the handle 46 can be extended to serve as a back and head support, as schematically shown in FIG. 10**.

Figure 8:
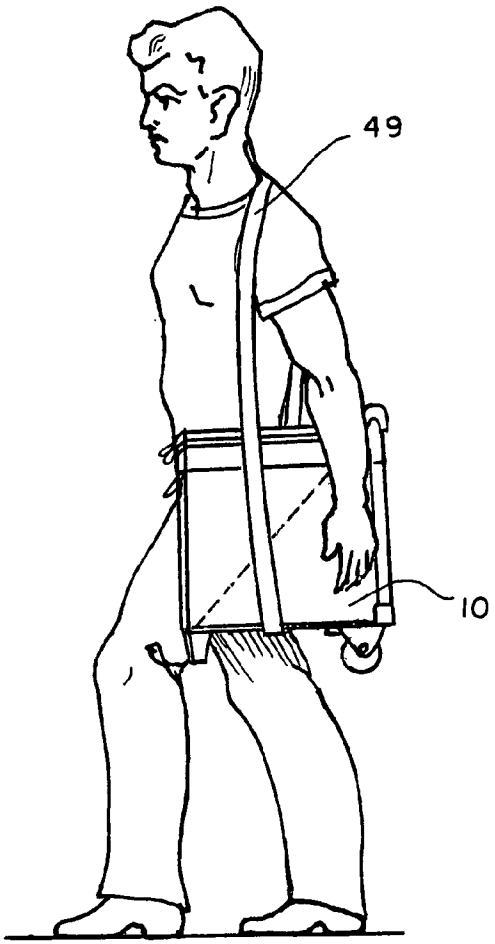
FIG. 8 is a schematic view illustrating the cooler apparatus of the present invention being carried by a shoulder strap by a user.

A shoulder strap 49 is positioned in a pocket 51 secured to the cage 48. The shoulder strap is rolled into the pocket 51 when not in use and is unfurled from the pocket 51 when a user desires to carry the cooler 10 over the shoulder (FIG. 8) instead of rolling on wheels (FIG. 7). An outer surface of the pocket 51 can be formed from a stretchable nylon or other suitable lightweight material. The cage 48 can be secured to the back wall 22 using rivets 53 and screws 55.

Figure 1:
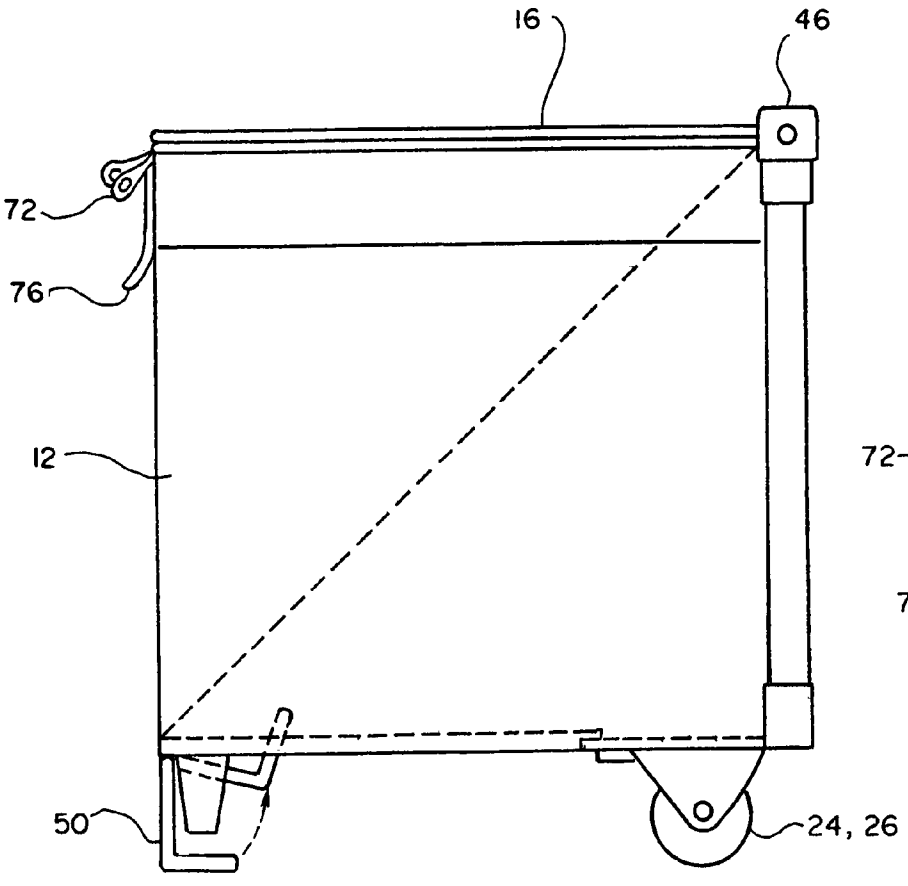
FIG. 1 is a side view of the cooler apparatus of the present invention, with a handle in a retracted position.

An engagement hook 50 is secured to the bottom wall 18 of the cooler body midway between the stationary legs 40, 42. The hook 50 is spring loaded to normally retain the hook 50 in a fold away position, under the bottom wall 18, as shown in FIG. 1. The user pulls the hook 50, against the force of the spring (not shown) forward to lower the hook 50 into a position ready for mounting. When the cooler 10 is used as a stadium seat, the hook 50 engages an edge 52 of a stadium bench 54 to stabilize position of the cooler/stadium seat 10 on the bench. To remove the cooler 10 from the bench 54 the user removes the hook 50 and allows the spring to pull back the hook 50 into a folded away position below the bottom wall 18.

The cooler 10 has one or more rigid plates 60, 62 positioned on the bottom wall 18 to provide solid support for the weight of the food placed in the cooler 10, as well as for a person seating in the converted seat. The plates 60, 62 can be formed from plywood, such as ⅛" thick sheet of plywood cut to fit the interior of the cooler 10. The plywood plate 60 can be used for attachment of the front legs 40, 42, and the plywood plate 62 can be sued for attachment of the wheel sets 24, 26.

A layer of padding 64 is placed over the plate 60 to provide more comfortable seating for the user. The padding layer 64 can be formed from an open-cell foam material, for instance memory foam, and be ¼" thick. Another layer of padding 66 is inserted under the top lid 16 to form padding for the back of the converted stadium seat.

An insulating layer 68 covers the padding layer 64. The insulating layer 68 can be formed from a thermo plastic material. A similar insulating material can be positioned on the first sidewall 12, the second sidewall 14, the top lid 16, the front wall 20 and the rear wall 22 inside the cooler 10.

A zipper 70 secures the top lid 16 to the sidewalls 12, 14 and the rear wall 22. The zipper 70 can be a heavy duty weatherized rubber coated zipper. The ends of the zipper 70 are provided with gripping members 72 to allow opening and closing of the zipper 70 for access to the interior chamber 11 of the cooler 10. Clips can be provided on the zipper gripping members 72 for attaching of the shoulder strap 49.

Figure 5:
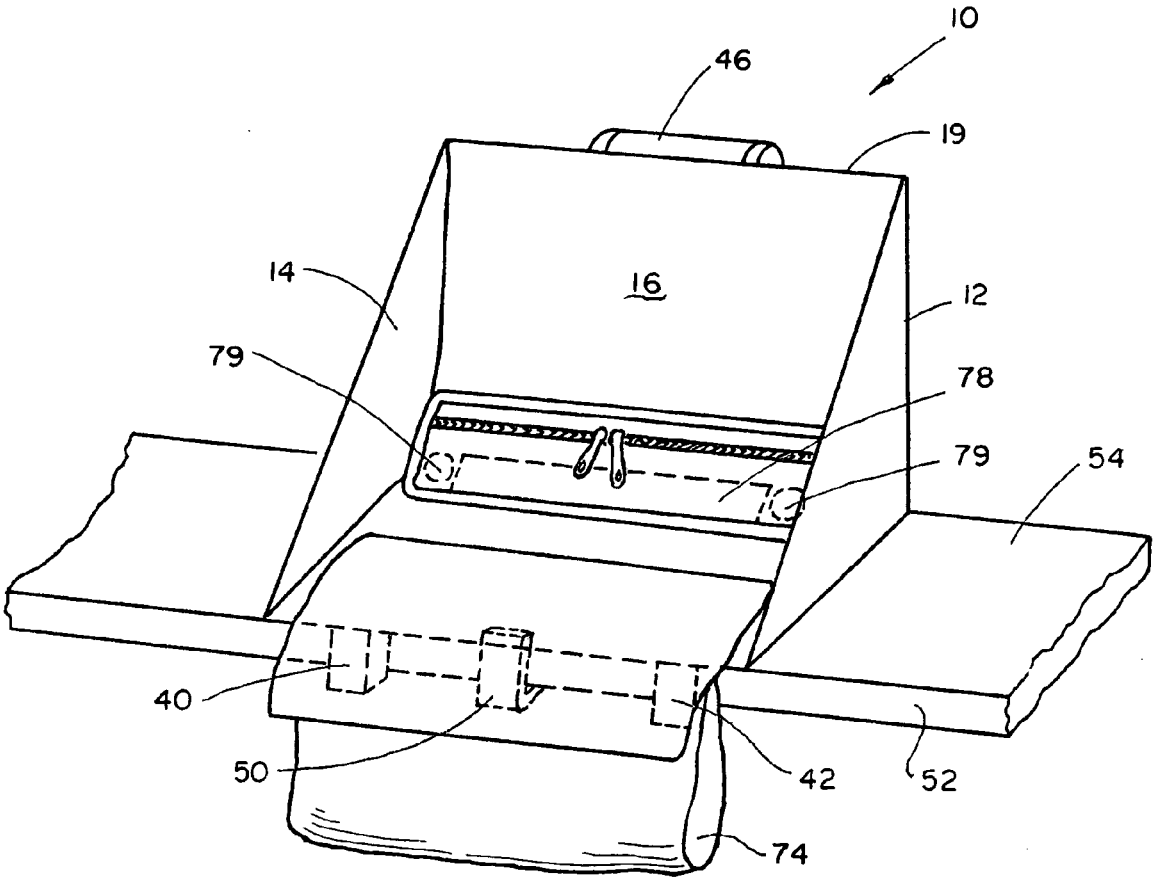
FIG. 5 is a perspective view illustrating the cooler apparatus converted into a stadium seat.
Figure 6:
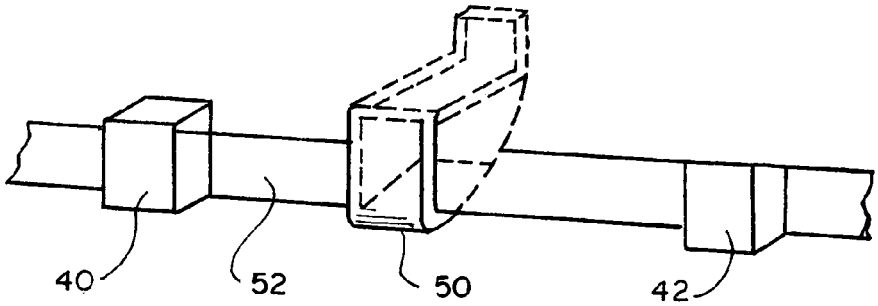
FIG. 6 is detail perspective view illustrating the engagement hook mounted on the edge of a stadium bench.

A flexible collapsible foldable pouch 74 is fitted in a pocket (not shown) behind the zipper 70 below the insulating layer 68. When the cooler 10 is converted into a stadium seat (FIG. 5) the pouch 74 can be unfurled, as shown in FIG. 5, and placed across the front portion of the bottom wall/seat base to cover the hook 50. The pouch 74 can be used for retaining small items, such as glasses, binoculars and the like. The pouch 74 can be secured to the bottom wall using hook-and-loop fasteners (not shown) or other securing means.

Figure 11:
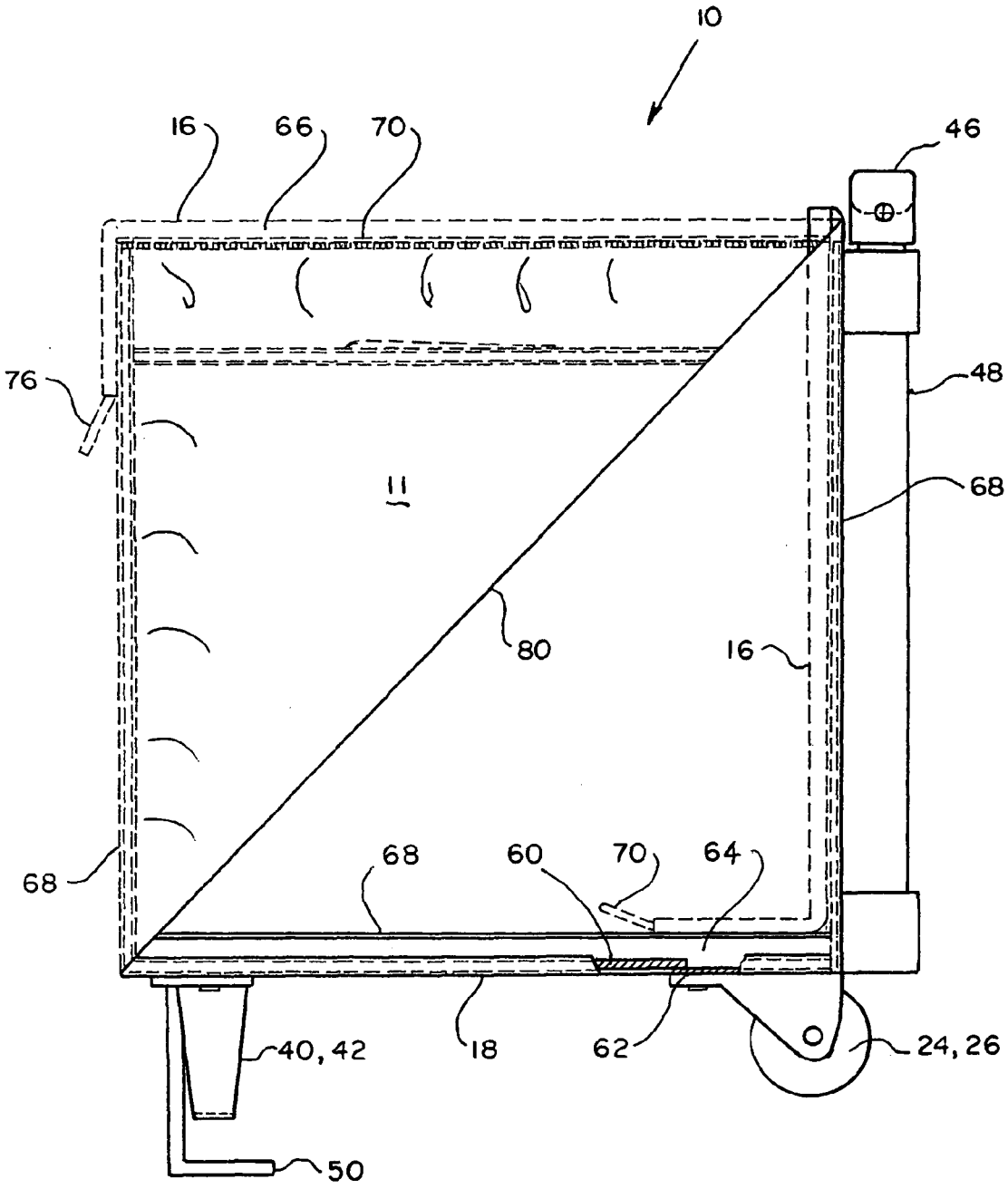
FIG. 11 is side view showing inner construction of the cooler apparatus of the present invention.

A pull tab 76 is secured to the front of the top lid 16. The tab 76 serves as a gripping tab for lifting the top lid 16. A band 78 of hook-and-loop fasteners is secured to the interior surface of the portion 17 of the top lid 16. When the lid is opened and pushed toward the inner surface of the rear wall 22, the band 78 is attached to a matching band of hook-and-loop fasteners mounted on the back of the bottom wall 18, securing the lid 16 to the rear wall 22 and the bottom wall 18. Additionally, a pair of snaps 79 may be provided on opposite sides of the band 78 to stabilize fold-back position of the top lid 16 in the converted stadium seat position. This position of the top lid 16 is shown in phantom line in FIG. 11 and illustrated in FIG. 5. When converting the cooler 10 to a stadium seat, the user also folds the sidewalls 12, 14 inwardly at approximately 45-degree angle along imaginary lines 80, pushing the top front portions of the sidewalls 12, 14 against the bottom rear portions thereof. The diagonally folded portions of the sidewalls 12 and 14 form the inner parts of the stadium seat sides, as can be seen in FIG. 5, while the lower portions form the outer sides of the stadium seat. The bottom of the shell forms the base of the stadium seat.

The distance between the front legs 40, 42 and the wheel sets 24, 26 is selected to be at least slightly greater than the width of the stadium bench 54. Typically, a stadium bench is about 11 inches wide. When positioned on the bench 54, the cooler 10, now the stadium seat, is firmly anchored against the bench by the front legs 40, 42, the hook 50 and the wheel sets 24, 26. The converted stadium seat can be easily returned to its original form and shape to become a cooler for next use.

Many changes and modifications can be made in the present invention without departing from the spirit thereof. I, therefore, pray that my rights to the present invention be limited only by scope of the appended claims.

I claim:

1. A collapsible cooler apparatus convertible to a stadium seat, comprising:

a flexible collapsible shell having a front wall, a back wall, a pair of opposing sidewalls, a bottom wall and a top lid pivotally secured to the back wall, said top lid being configured to fold down against an inner surface of the back wall and together with the back wall, form an upright back of the stadium seat, and wherein said sidewalls having top portions being configured to fold down against bottom portions of the sidewalls while lower portions of the sidewalls remain unfolded, said top portions and said lower portions forming upright sidewalls of the stadium seat.

2. The apparatus of claim 1, further comprising a set of rotating wheel sets secured to the back and bottom walls of the shell.

3. The apparatus of claim 2, further comprising a pair of spaced-apart stationary legs secured to a front portion of the bottom wall.

4. The apparatus of claim 1, further comprising an engagement hook secured to exterior of the bottom wall, said engagement hook being movable between a normally folded position under the bottom wall and a retracted position forwardly of the front wall, said hook being configured to detachably engage a stadium bench, while the bottom wall is configured to rest on the stadium bench.

5. The apparatus of claim 4, wherein said engagement hook is spring loaded for retaining the engagement hook in a normally folded position.

6. The apparatus of claim 1, wherein at least one rigid plate is positioned on an interior surface of the bottom wall.

7. The apparatus of claim 6, wherein a padding layer is positioned over said at least one plate.

8. The apparatus of claim 7, wherein said padding layer is formed from an open-cell foam material.

9. The apparatus of claim 1, wherein a padding layer is secured to an interior surface of the top lid.

10. The apparatus of claim 1, further comprising an insulating layer mounted on interior surfaces of the shell.

11. The apparatus of claim 1, further comprising a handle cage secured to an outside surface of the back wall, and wherein a retractable handle is secured in said handle cage.

12. The apparatus of claim 11, wherein said handle is a telescopically extendable handle.

13. The apparatus of claim 11, further comprising a pocket secured to the handle cage.

14. The apparatus of claim 13, further comprising a shoulder strap removably positioned in said pocket.

15. The apparatus of claim 1, further comprising a flexible pouch configured to be detachably secured to the bottom wall and to extend downwardly from the bottom wall when the cooler is converted to form the stadium seat.

16. The apparatus of claim 1, wherein said top portions of the sidewalls are each configured to fold diagonally inwardly when forming upwardly extending walls of the stadium seat.

17. The apparatus of claim 1, wherein a band of hook-and-loop fasteners is positioned on an inner surface of the top lid and a matching band of hook-and-loop fasteners is positioned on an inner surface of the bottom wall, said hook-and-loop fasteners being engageable for detachably securing the top lid in a folded down position, while forming the upright back of the stadium seat.

18. A method of converting a cooler into a stadium seat, comprising the steps:

providing a flexible collapsible shell having a front wall, a back wall, a pair of opposing sidewalls and a top lid pivotally secured to the back wall along a pivot line;

folding the top lid along the pivot line downwardly and inwardly such that the lid extends along the back wall and together with the back wall forms an upright back of the stadium seat;

folding upper portions of each of the sidewalls downwardly and inwardly against lower portions of the sidewalls, thereby forming upright sides of the stadium seat.

19. The method of claim 18, further comprising a step of providing hook-and-loop fasteners on a portion of the top lid and an inner surface of the bottom wall and engaging the hook-and-loop fasteners to thereby secure the top lid in a substantially vertical orientation against the back wall while the top lid and the back wall form the upright back of the stadium seat.

20. The method of claim 18, further comprising a step of providing an engagement hook and securing the engagement hood to exterior of the bottom wall, said engagement hook being movable between a normally folded position under the bottom wall and a retracted position forwardly of the front wall.

21. The method of claim 20, further comprising a step of moving the engagement hook into a retracted position prior to mounting the cooler on a stadium bench, while engaging the engagement hood with the stadium bench.

22. The method of claim 18, wherein said engagement hook is spring loaded for retaining the engagement hook in a normally folded position.

23. The method of claim 18, further comprising a step of providing handle cage secured to an outside surface of the back wall and securing a retractable handle in said handle cage.

24. The method of claim 23, wherein said handle is a telescopically extendable handle.

25. The method of claim 23, further comprising a step of providing a pocket secured to the handle cage and providing a shoulder strap removably positioned in said pocket.

26. The method of claim 18, further comprising a step of providing a flexible pouch and detachably securing said flexible pouch to inside surface of the bottom wall when the cooler is converted to form the stadium seat, said pouch extending below the bottom wall when the cooler is converted to form the stadium seat.

27. The method of claim 18, further comprising the step of providing a set of rotating wheel sets secured to the back and bottom walls of the shell and a pair of spaced-apart stationary legs secured to a front portion of the bottom wall.

* * * * *